US005742945A

United States Patent [19]

Lindaman

[11] Patent Number: 5,742,945

[45] Date of Patent: Apr. 28, 1998

[54] SOCK WITH SHIN GUARD FASTENER

[76] Inventor: Glenn Lindaman, 690 S. 10th St., Allentown, Pa. 18103

[21] Appl. No.: 802,942

[22] Filed: Feb. 21, 1997

[51] Int. Cl.[6] ..... A41D 13/00

[52] U.S. Cl. ..... 2/239; 2/22

[58] Field of Search ..... 2/22, 239, 23, 2/24, 240, 241, 242

[56] References Cited

U.S. PATENT DOCUMENTS

| | | | |
|---|---|---|---|
| 1,225,354 | 5/1917 | Pierce | 2/22 |
| 2,544,065 | 3/1951 | Carr | 2/22 |
| 3,465,364 | 9/1969 | Edelson | 2/22 |
| 4,001,953 | 1/1977 | Fugere et al. | 2/22 |
| 4,306,315 | 12/1981 | Castiglia | 2/22 |
| 4,497,070 | 2/1985 | Cho | 2/22 |
| 4,599,812 | 7/1986 | Harmsen | 2/239 |
| 4,669,126 | 6/1987 | Jones | 2/22 |
| 4,926,501 | 5/1990 | Goosen | 2/22 |
| 5,570,470 | 11/1996 | Miller | 2/22 |
| 5,581,817 | 12/1996 | Hicks | 2/239 |
| 5,634,211 | 6/1997 | Chen | 2/22 |

*Primary Examiner*—Amy B. Vanatta
*Attorney, Agent, or Firm*—Eckert Seaman Cherin & Mellott

[57] ABSTRACT

An article of protective apparel for securing the position of a shin guard. The article comprises upper and lower fasteners straps attached to a sock such that a shin guard can be placed between the fasteners. When the fasteners are cinched, the position of the shin guard is secured.

12 Claims, 3 Drawing Sheets

SOCK WITH SHIN GUARD FASTENER

BACKGROUND OF THE INVENTION

1. Field of the Invention

The invention relates to the field of protective outerwear, and in particular concerns a sock with a means of securing the position of a shin guard placed between the sock and a person's shin.

2. Prior Art

In several sports, players use protective apparel to protect their bodies from inadvertent or advertent impacts by their own or opposing teammates. In sports where much of the contention over the playing object, such as a ball or puck, takes place proximate to a player's feet, it is desirable to protect a player's shins from possible impacts.

It is known in sports such as soccer and field hockey to protect a player's shins by placing a shin guard between a player's sock and shin. Shin guards are commonly composed of hard plastic facing outward with a softer backing facing the shin.

When shin guards are placed between the sock and shin, it is common for their position to shift during use, often resulting in discomfort, reduced protection, and the need for readjustment. Discomfort and irritation may occur when a shin guard slides down the shin to interfere with ankle movement and protection is reduced when the shin guard moves from a position where the shin is likely to be struck.

The degree to which a shin guard's position will shift during use will vary with the age and type of sock used and the sizes and shapes of a person's shin and shin guard. Readjustment of shin guard positioning is annoying and detracts from player's competitive effectiveness. It is not an acceptable solution to apply adhesive tape to increase constriction adjacent to the shin guard. What is needed is a means of minimizing movement of a shin guard that is comfortable, versatile so a shin guard can be placed in multiple positions, and convenient so a shin guard can be positioned quickly and easily for maximum comfort and protection.

SUMMARY OF THE INVENTION

It is an object of the invention to provide protective apparel that will retain a shin guard in a position of protection and comfort.

It is a further object of the invention to provide a means of quickly and easily adjusting the position of the shin guard.

It is a further object of the invention to decrease the likelihood of accidental release and/or displacement of the shin guard.

These and other objects are accomplished by a sock with attached upper and lower fasteners which can be cinched to secure a shin guard between them by providing resilient constrictions on or above and/or below the shin guard on the wearer's leg. The fasteners are comprised of hook and pile fasteners such as Velcro for easy adjustment of position and tension. The upper fastener can be located below the top of the sock, so the sock can be folded over the upper fastener to protect the fastener from opening.

The sock can have vertical or horizontal ribbing to further prevent movement of the shin guard. Elastic bands can be attached around the sock at the location of each cinching fastener so that fastener tension is not dependent upon sock elasticity.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
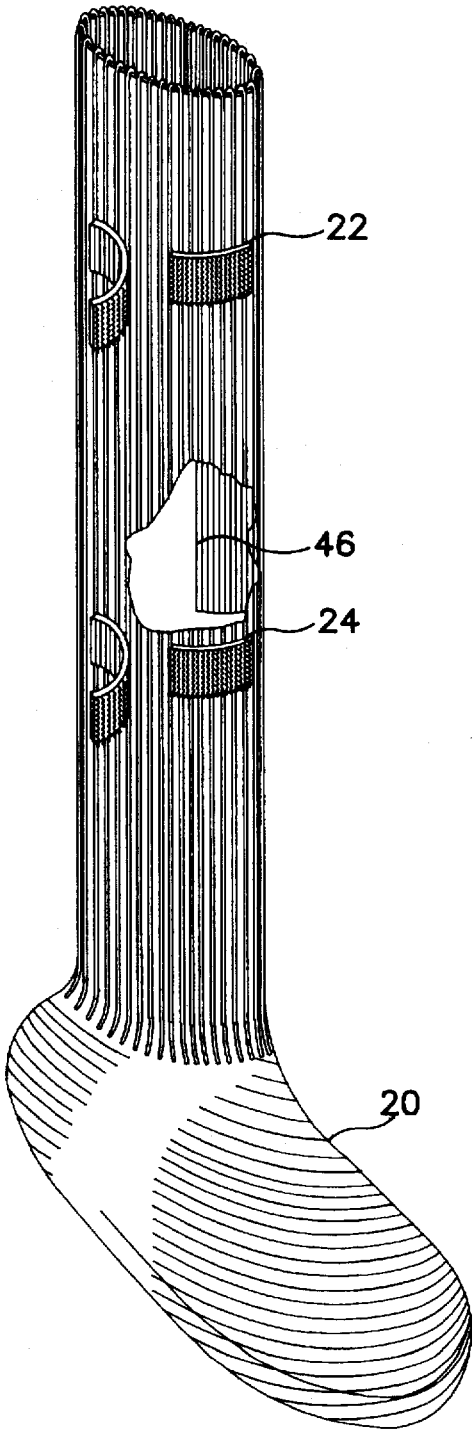
FIG. 1 is a perspective view of the invention on a ribbed heel sock with the top unfolded.

Referring to FIG. 1, an upper fastener 22 and a lower fastener 24 are attached to a sock 20. The sock can be a heel sock 20, a tube sock 30, or other type of sock since all are applicable to the invention means used secure a shin guard as described herein. Preferably, the fasteners 22, 24 are located on a lateral side of the sock. Preferably, the upper fastener 22 and lower fastener 24 are comprised of hook and pile mating strips such as Velcro. The use of velcro allows simple, quick, and easy adjustment of the location tension of the fasteners 22, 24. The mating strips are attached at circumferentially spaced joints and can be overlapped to any degree over a range whereby the circumference of the sock can be shortened or cinched at the strips.

Figure 5:
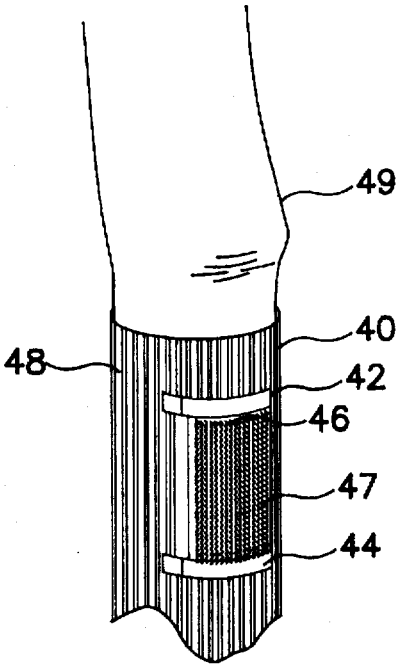
FIG. 5 is a left side elevational view of the invention on a ribbed sock with a ribbed shin guard.

In one embodiment exemplified in FIG. 5, the fasteners 42, 44 are located a vertical distance apart greater than the length of the shin guard 46. In this embodiment, the distance between the upper and lower fasteners 42, 44, will depend on the size of the shin guard 46 used. A larger shin guard 46, presumably used by a larger person with a larger leg, will necessitate a larger distance between the upper and lower fasteners 42, 44 and vice versa. In this embodiment, the tension in the sock 40 due to cinching the fasteners 42, 44, will close any sock space above and below the shin guard, thereby sustaining the vertical location of the shin guard 46. The sock 40 can have vertical ribs 48 to prevent the shin guard 46 from rotating about the leg 49. The shin guard 46 can have corresponding ribs 47 to engage the sock and further prevent rotation of the shin guard 46.

Figure 6:
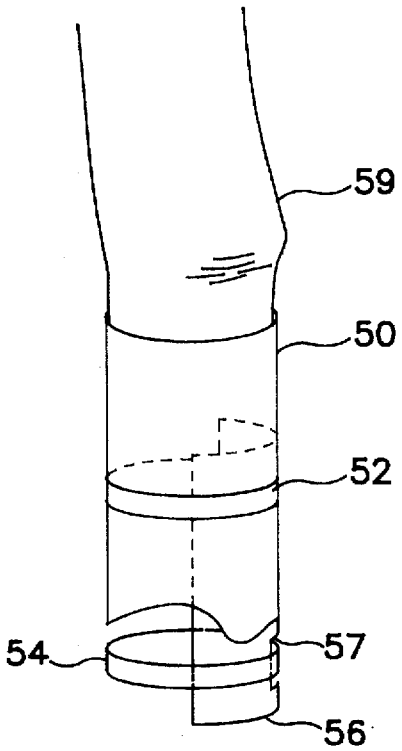
FIG. 6 is a left side elevational view of the invention on a non-ribbed sock with fasteners that extend completely around the sock and with a shin guard that has complementary recesses at the fastener locations.
Figure 7:
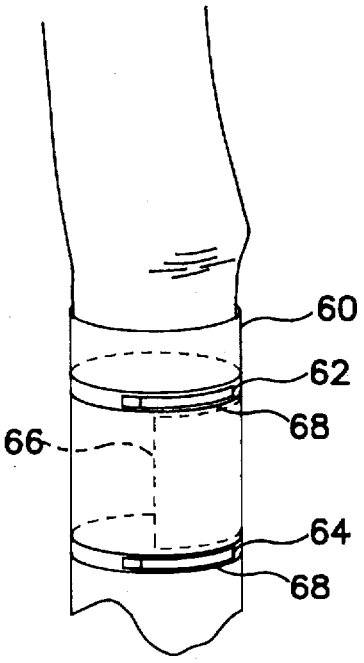
FIG. 7 is a left side elevational view of the invention on a non-ribbed sock having an elastic band that together with said fastener extends around a full circumference of the sock.

In another embodiment exemplified in FIG. 6, the fasteners 52, 54 are located a distance apart less than the length of the shin guard 56. When a fastener 52, 54 is cinched, this results in tension in the sock 50 at a location coincident with the shin guard 56 intending to hold the shin guard more tightly against the leg 59. The shin guard 56 can have a complementary recess 57 at this location to help sustain the position of the shin guard 56.

Figure 2:
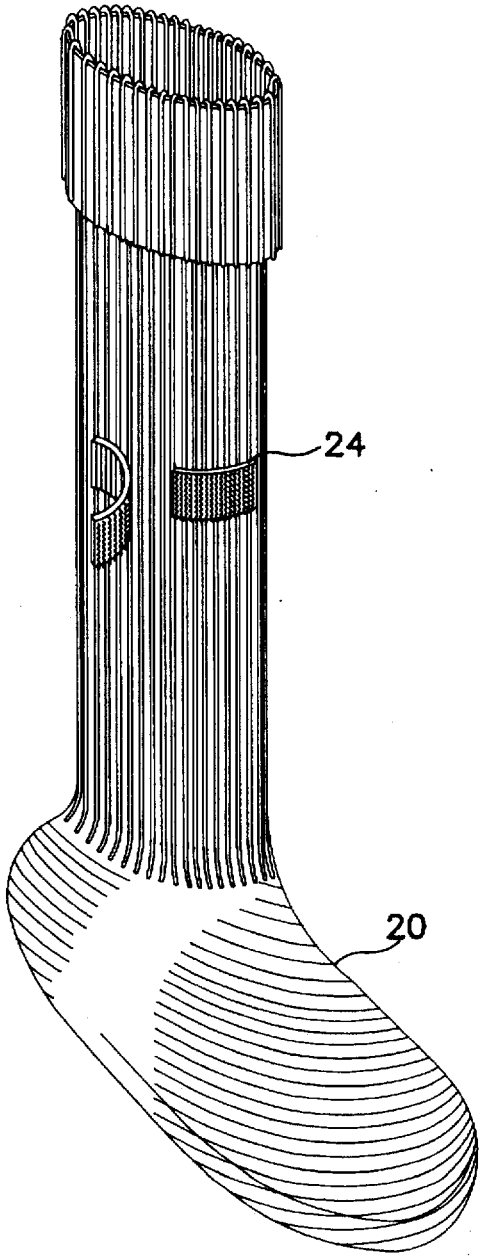
FIG. 2 is a perspective view of the invention on a ribbed heel sock with the top of the sock folded over.
Figure 3:
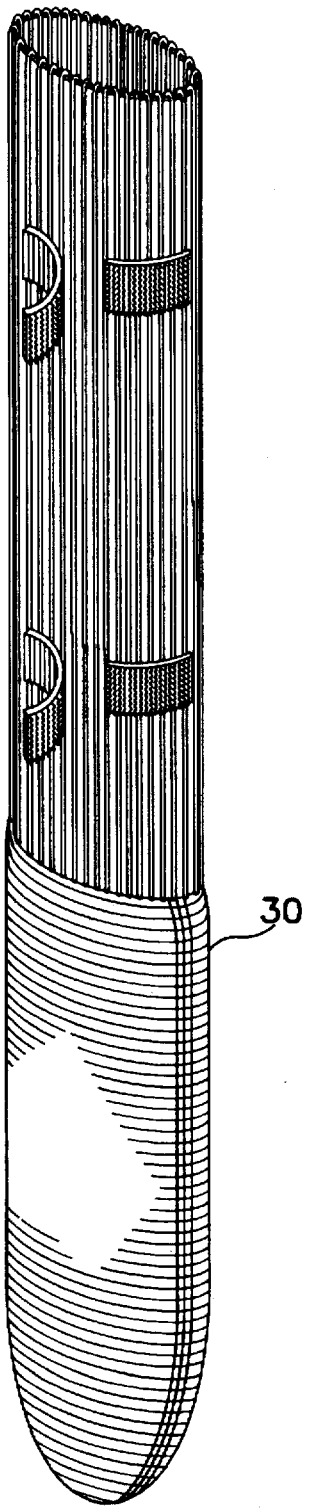
FIG. 3 is a perspective view of the invention on a ribbed tube sock with the top unfolded.
Figure 4:
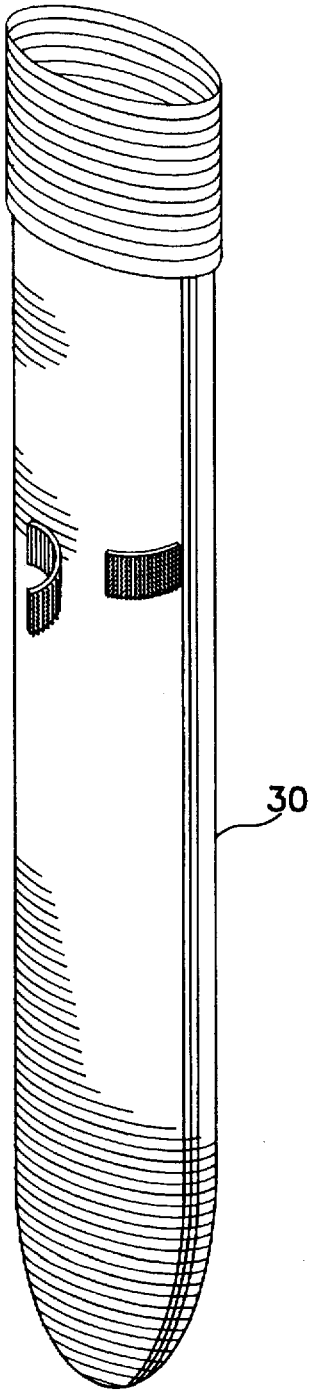
FIG. 4 is a perspective view of the invention on a non-ribbed tube sock with the top of the sock folded over.

When the upper fastener 22 is located below the top of the sock 20 as in FIG. 1, the top of the sock can be folded over as in FIG. 2 to cover the fastener. This provides the advantage of protecting the upper fastener from contact that could inadvertently release the fastener from a cinched position during use and additionally is more aesthetically desirable.

The fasteners 62, 64, create tension in the sock 60 when cinched. This tension will vary with the elasticity of the sock 60. An elastic band 68 or belt can be attached to the sock 60 at a location coincident with a fastener 62, 64 to allow greater tension at the fastener's location without the need for tension in the entire sock 60. This belt also can be made relatively less resiliently extendible than the material of the sock. This provides the advantage of allowing the use of comfortable socks that are not constricting in combination with focused tension created by cinching the fasteners.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. An article of protective apparel for securing the position of a shin guard comprising:

a sock having an upper end, a lower end, and an elongated cylindrical leg section;

at least one upper fastener and at least one lower fastener attached to the sock, the lower fastener positioned a distance apart from the upper fastener and closer to the lower end of the sock than the upper fastener, the upper and lower fasteners each being adjustably operable to shorten an upper and a lower circumference of the sock, whereby a receptacle for a shin guard is formed between the upper and lower fasteners.

2. An article of protective apparel according to claim 1, wherein the upper and lower fasteners comprise hook and pile fasteners.

3. An article of protective apparel according to claim 1, wherein the upper fastener is disposed at a space below the upper end of the sock whereby the upper end of the sock can be folded over to cover the upper fastener.

4. An article of protective apparel according to claim 1, further comprising at least one middle fastener attached to the sock between the upper and lower fasteners and operable to shorten a circumference of the sock between the upper and lower fasteners.

5. An article of protective apparel according to claim 1, wherein the upper and lower fasteners comprise adjustably overlapped mating strips positioned substantially on a lateral side of the sock.

6. An article of protective apparel according to claim 1, wherein at least one of the upper and lower fasteners is attached to a belt extending completely around the sock.

7. An article of protective apparel according to claim 1, wherein an elasticity of the sock is varied at the location of at least one of the upper and lower fasteners, whereby the tension created by cinching the fastener exceeds the elasticity of the sock.

8. An article of protective apparel according to claim 7, wherein the elasticity is varied by an elastic band that together with said fastener extends around a full circumference of the sock.

9. An article of protective apparel according to claim 1, wherein the sock has a vertical axis extending from the upper end of the sock to the lower end of the sock and the sock has ribbing parallel to the vertical axis, whereby the ribbing prevents the shin guard from rotating around the shin.

10. An article of protective apparel comprising:

a sock having an upper end, a lower end, and an elongated cylindrical leg section;

a shin, guard;

an upper fastener and a lower fastener attached to the sock, the lower fastener positioned a distance apart from the upper fastener and closer to the lower end of the sock than the upper fastener, the distance being greater than the length of the shin guard, the upper and lower fasteners each being adjustably operable to shorten an upper and a lower circumference of the sock.

11. An article of protective apparel comprising:

a sock having an upper end, a lower end, and an elongated cylindrical leg section; a shin guard;

an upper fastener and a lower fastener attached to the sock, the lower fastener positioned a distance apart from the upper fastener and closer to the lower end of the sock than the upper fastener, the distance being less than the length of the shin guard.

12. An article of protective apparel according to claim 11 wherein the shin guard has at least one recess complementary to at least one of the upper and lower fasteners.

* * * * *